United States Patent [19]

Park

[11] Patent Number: 5,032,956

[45] Date of Patent: Jul. 16, 1991

[54] LAMP COVER ASSEMBLY FOR ELECTRIC APPLIANCES

[75] Inventor: Hwa S. Park, Kyunggi, D.P.R. of Korea

[73] Assignee: Samsung Electronics Co., Ltd., Suwon, Rep. of Korea

[21] Appl. No.: 360,462

[22] Filed: Jun. 2, 1989

[30] Foreign Application Priority Data

Jun. 2, 1988 [KR] Rep. of Korea ..... 1988-8620

[51] Int. Cl.[5] ..... F21V 33/00

[52] U.S. Cl. ..... 362/85; 362/374; 362/375; 362/282; 362/455

[58] Field of Search ..... 362/362, 374, 375, 368, 362/370, 371, 285, 287, 427, 455, 92, 226, 85, 282, 322, 323, 277, 280; 248/291

[56] References Cited

U.S. PATENT DOCUMENTS

| | | | |
|---|---|---|---|
| 2,130,328 | 9/1938 | Hoff | 362/322 |
| 2,545,508 | 3/1951 | Allen | 362/92 |
| 2,578,190 | 12/1951 | Kurtzon | 362/375 |
| 2,809,282 | 10/1957 | Cripe et al. | 362/92 |
| 3,764,793 | 10/1973 | Binzer | 362/322 |
| 3,858,042 | 12/1974 | Peterson | 362/374 |
| 4,107,766 | 8/1978 | Baker | 362/226 |
| 4,538,217 | 8/1985 | Ewing et al. | 362/287 |
| 4,621,180 | 1/1986 | Kristof et al. | 362/92 |

*Primary Examiner*—Ira S. Lazarus
*Assistant Examiner*—D. M. Cox
*Attorney, Agent, or Firm*—Sterne, Kessler, Goldstein & Fox

[57] ABSTRACT

A lamp cover assembly for electric appliances which enables a lamp cover to be disassembled without being completely separated from the bottom face of the appliance. The assembly includes a lamp cover support means on which the lamp cover is pivotally mounted so that the lamp cover pivots without being completely separated from the bottom face when it is disassembled for replacing the lamp.

3 Claims, 4 Drawing Sheets

LAMP COVER ASSEMBLY FOR ELECTRIC APPLIANCES

BACKGROUND OF THE INVENTION

1. Field of the Invention

The present invention relates to a lamp cover assembly for electric appliances, and more particularly to a cover assembly of a lamp which is attached to the bottom face of an electric appliance such as a microwave oven which is made to hang on or to be fixed to the wall.

2. Description of the prior art

In conventional lamp cover assemblies, both ends of a lamp cover are assembled to the bottom plate of the appliance such as a microwave oven by set screws, or one of the ends is inserted to the bottom plate while the other is assembled to the plate by the set screw.

However, in this type of a lamp cover assembly, the lamp cover is separated completely from the bottom plate when it is disassembled for replacing the lamp. Accordingly, the lamp cover is apt to be dropped due to mishandling when is disassembled and assembled for the replacement of the lamp, causing a light-permeable glass assembled to the lamp cover to be damaged or broken. Further, because the above-mentioned lamp cover assembly has the structure in that separate upper and lower lamp covers are fastened by respective set screws to support and fix the light-permeable glass, the assembly suffers from the disadvantage of high manufacturing cost due to the increase of the number of the components and the manufacturing processes thereof.

SUMMARY OF THE INVENTION

It is an object of the present invention to provide a lamp cover assembly for electric appliances which enables the lamp cover to be disassembled without being completely separated from the bottom face of the appliance.

It is another object of the present invention to provide a lamp cover assembly for electric appliances in which the number of components is reduced due to its simple structure.

According to the present invention, there is provided a lamp cover assembly for electric appliances which comprises a lamp cover having a first hole formed therein and a plurality of fixing members for fixing a light-permeable glass, said lamp cover also including first hinge portion and first thread fastening portion respectively formed on each of the two ends thereof; and a lamp cover support means provided on the bottom face of said appliance, said support means having second hole formed on said bottom face and at least two support members formed on the upper periphery of said second hole, said support means also including second hinge portion formed on one end of said second hole and pivotally connected to said first hinge portion and second thread fastening portion formed on the other end of said second hole and fastened with said first thread fastening portion by a set serew.

BRIEF DESCRIPTION OF THE DRAWINGS

The present invention will now be described by way of illustrative example with reference to the accompanying drawings, in which.

DETAILED DESCRIPTION OF THE PREFERRED EMBODIMENT

Figure 1:
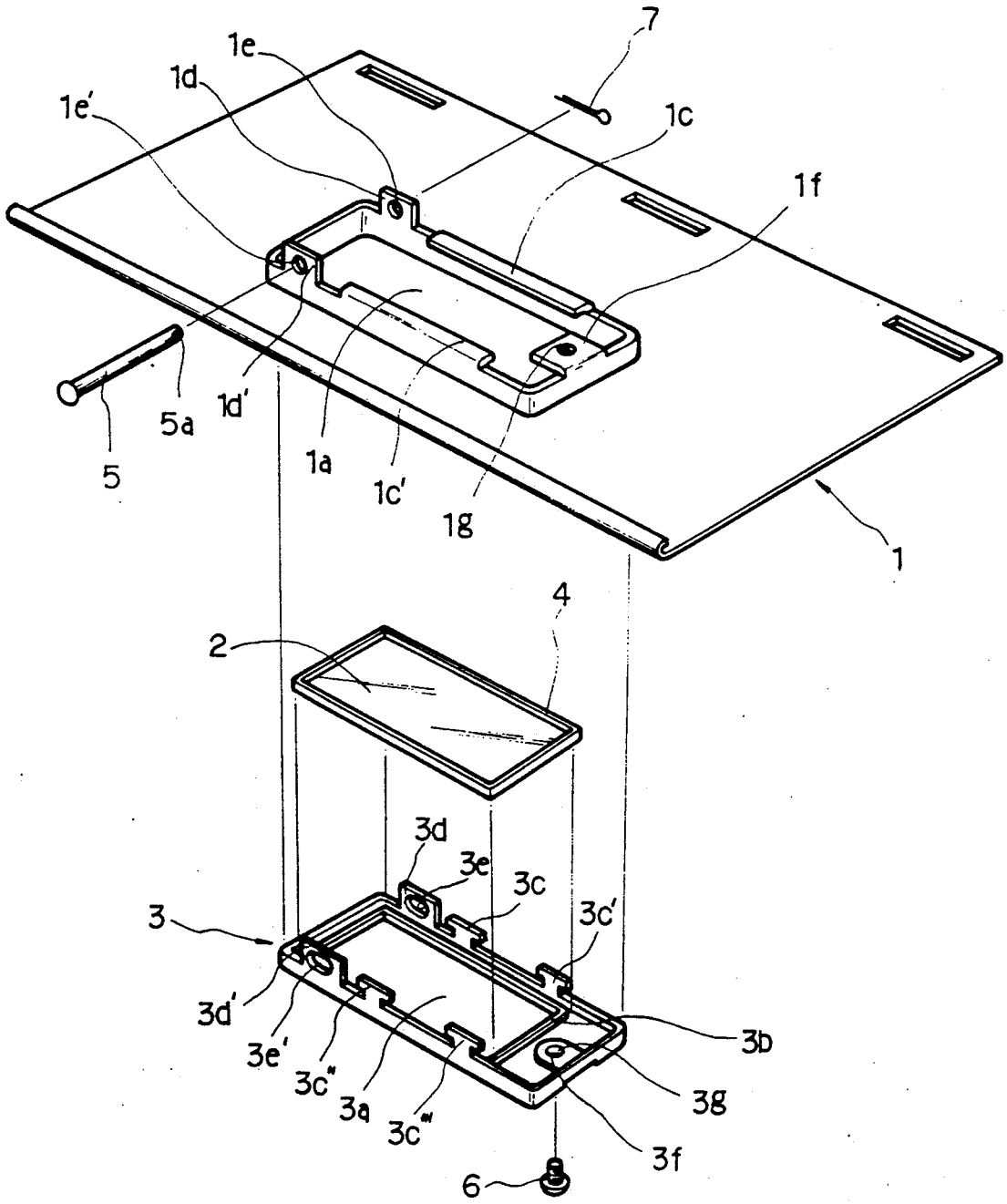
FIG. 1 is an exploded perspective view of a lamp cover assembly according to the present invention.
Figure 2:
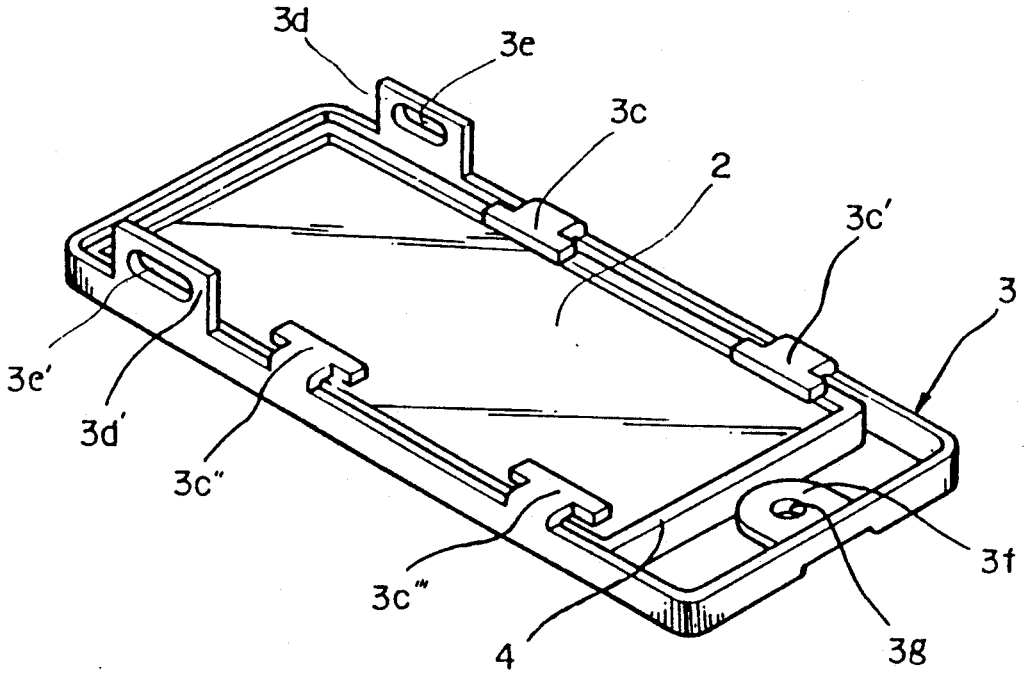
FIG. 2 is a perspective view showing a lamp cover in FIG. 1 to which a light-permeable glass is fixed.
Figure 3:
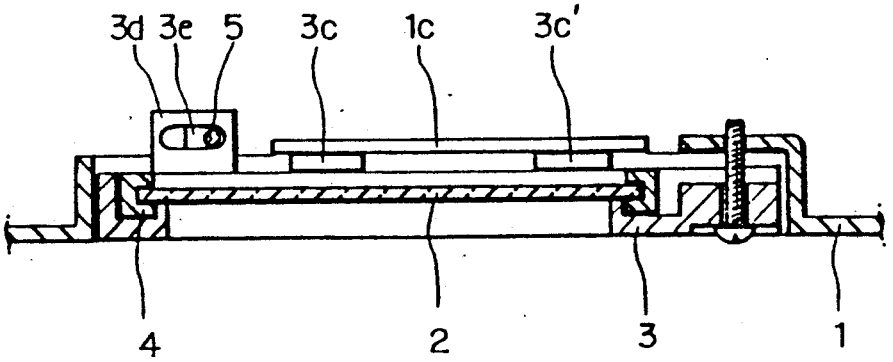
FIG. 3 is a sectioned side elevation of the lamp cover assembly of FIG. 1, in an assembled state.
Figure 4A:
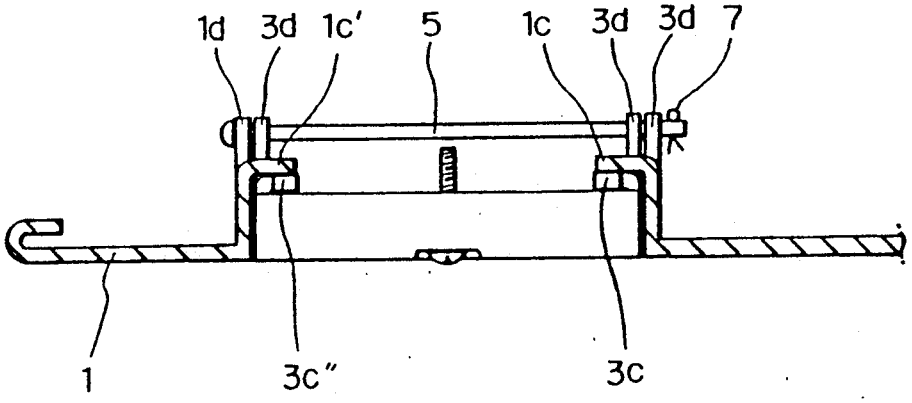
FIG. 4A is an enlarged sectioned elevation of the lamp cover assembly of FIG. 1 taken on line A—A of FIG. 1.
Figure 4B:
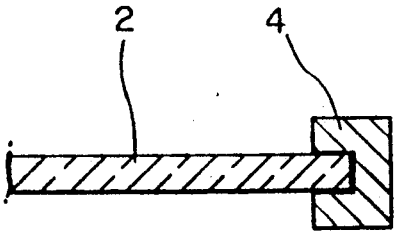
FIG. 4B is an enlarged sectioned elevation of part of the lamp cover assembly of FIG. 1 taken on line B—B of FIG. 1.
Figure 5:
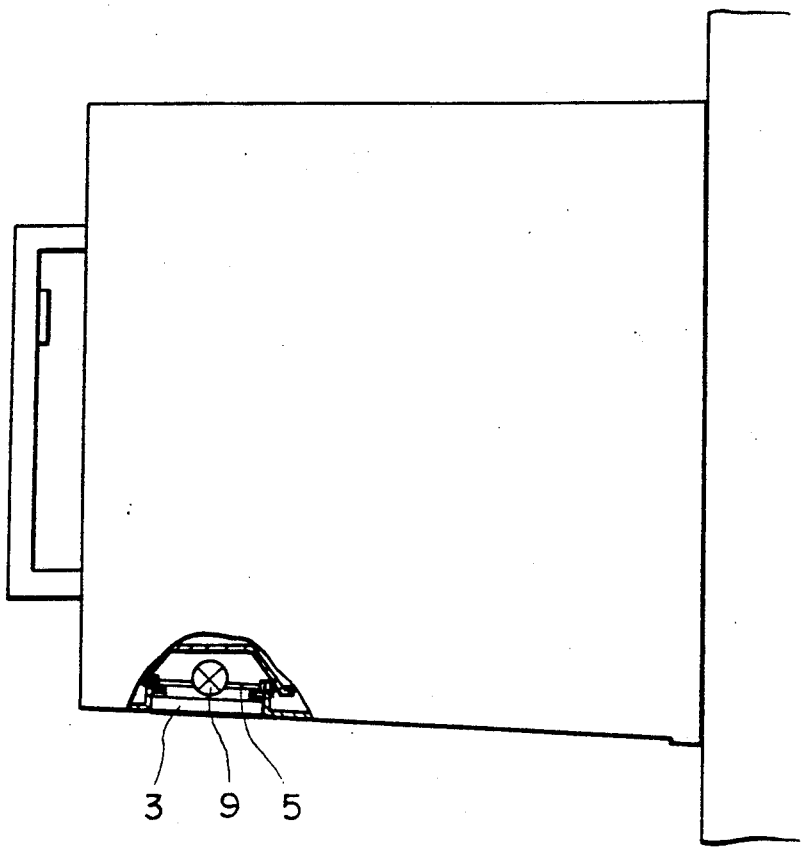
FIG. 5 is a partially sectioned side elevation of a microwave oven incorporating the lamp cover assembly according to the present invention.

Referring to FIG. 1, the light-permeable glass 2 is mounted on first hole 3*a* formed on the lamp cover 3 and the lamp cover 3 is then placed in second hole 1*a* formed on the bottom plate 1 of the appliance. The lamp cover support means is provided to the upper periphery of the second hole 1*a* of the bottom plate 1. In the embodiment of the present invention, the lamp cover support means comprises hinges 1*d* and 1*d'* provided vertically at one end of the hole 1*a* and having insertion holes 1*e* and 1*e'* for a hinge shaft 5, a thread fastening portion 1*f* provided at the other end of the hole 1*a* and having a thread fastening hole 1*g*, and at least two support members 1*c* and 1*c'* folded inwardly of the light-permeable hole 1*a* at the middle portions of the hole 1*a* respectively. A cushion 4 is provided along the whole periphery of the light-permeable glass 2.

On the other hand, a shoulder 3*b* of the light-permeable glass 2 is provided along the periphery of the first hole 3*a* of the lamp cover 3 in order to prevent the glass 2 from moving by itself. At one end of the hole 3*a*, hinges 3*d* and 3*d'* having elliptical insertion holes 3*e* and 3*e'* for the hinge shaft 5 are provided in parallel. At the other end of the hole 3*a* , a thread fastening portion 3*f* having a fastenting hole 3*g* through which a set screw 6 fastens is formed. A plurality of fixing members 3*c*, 3*c'*, 3*c''* and 3*c'''* of the light-permeable glass 2 are provided vertically at the periphery of the hole 3*g*, being arranged at suitable intervals with each other. At one end of the hinge shaft 5, an insertion hole 5*a* for a fixing clip 7 is formed.

In this embodiment, the lamp cover assembly of the present invention is assembled as follows:

At first, the light-permeable glass 2 is mounted on the upper portion of the first hole 3*a* of the lamp cover 3 so that the cushion 4 provided along the periphery of the light-permeable glass 2 is fitted to the shoulder 3*b* formed along the periphery of the hole 3*a* of the lamp cover 3. Next, the fixing members 3*c*, 3*c'*, 3*c''* and 3*c'''* projected from the periphery of the hole 3*a* are folded inwardly of the hole 3*a*, resulting in that the light-permeable glass 2 is fixed firmly to the lamp cover 3.

After the light-permeable glass 2 is fixed to the lamp cover 3, the lamp cover 3 is inserted and assembled to the second hole 1*a* on the bottom plate 1 of the appliance. In this moment, the insertion holes 1*e* and 1*e'* formed on the hinges 1*d* and 1*d'* are aligned with the elliptical insertion holes 3*e* and 3*e'* of the hinges 3*d* and 3*d'* and then the hinge shaft 5 is inserted through the aligned insertion holes 1*e*, 1*e'*, 3*e* and 3*e'*. When the fixing clip 7 is completely inserted to the insertion hole 5*a* formed on the hinge shaft 5, it will not be seperated. Consequently, one end of the lamp cover 3 is mounted pivotally on one end of the second hole 1*a* by the hinge shaft 5, and when the lamp cover 3 is disassembled, it pivots on the hinge shaft 5 without being completely separated from the bottom plate 1.

On the other hand, the first thread fastening portion 3*f* formed on the other end of the lamp cover 3 is aligned to the second thread fastening portion 1*f* of the other end of the hole 1*a* and then the set screw 6 is fastened through the fastening holes 3*g* and 1*g* of these fastening portions, causing the lamp cover 3 to be firmly fixed to the hole 1*a*. At this time, the lamp cover 3 remains not to be pushed up over the upper portion of the hole 1*a* because the upper periphery portions of the lamp cover 3 abut against the support members 1*c* and 1*c*'.

Figure 6:
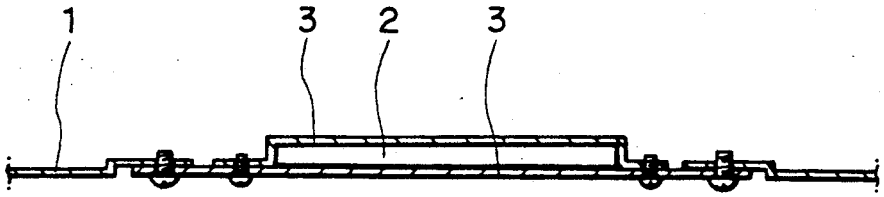
FIG. 6 is a sectioned elevation showing a lamp cover assembly according to the prior art.

From the foregoing, it will be apparent that by reason of the invention, the light-permeable glass 2 can be firmly fixed to the lamp cover 3 without the necessity of any other components and can be easily disassembled by unfastening the set screw 6, as compared to the conventional lamp cover assembly illustrated in FIG. 6. Furthermore, it is possible to disassemble or assemble the lamp cover 3 smoothly because the lamp cover 3, when disassembled, can be moved in a direction which is parallel to the bottom plate 1 due to the elliptical feature of the insertion holes 3*e* and 3*e*' of the hinges 3*d* and 3*d*'. moreover, as the lamp cover 3 according to the present invention is mounted to pivot on the hinge shaft 5 without being completely seperated from the plate 1 when it is disassembled, the light-permeable glass 2 wil be prevented from being dropped due to the user's mishandling.

While the present invention has been described and illustrated herein with reference to the preferred embodiment thereof, it will be understood by those skilled in the art that various changes in form and details may be made therein without departing from the spirit and scope of the invention.

What is claimed is:

1. A lamp cover assembly able to cover a light source disposed in a first light-permeable hole formed in a surface of an appliance, which lamp cover assembly comprises:

(a) a lamp cover support member comprising,
  (1) a first and second end,
  (2) a first and second side,
  (3) a flange projected upwardly and into said appliance surface along the periphery of said first light-permeable hole,
  (4) a first hinge portion composed of a first and second hinge shaft-receiving portions which are upwardly projected on said first end of said lamp cover support member, said first hinge shaft-receiving portion being positioned on said first side and said second hinge shaft-receiving portion being positioned on said second side, and
  (5) a first fastening portion formed on said second end of said lamp cover support member;

(b) a lamp cover comprising,
  (1) a first and second end,
  (2) a first and second side,
  (3) a second light-permeable hole formed therein in conformity with said first light-permeable hole,
  (4) a light-permeable glass disposed in a shoulder provided along the periphery of said second light-permeable hole,
  (5) a cushion member placed between said light-permeable glass and said shoulder,
  (6) a plurality of fixing members projected inwardly from the upper periphery of said second light-permeable hole and arranged at suitable intervals with each other in order to fix said light-permeable glass in place,
  (7) a second hinge portion upwardly projected on said first end of said lamp cover, said second hinge portion being composed of a third and fourth hinge shaft-receiving portions, said third hinge shaft-receiving portion being positioned on said first side and said fourth hinge shaft-receiving portion being positioned on said second side, and
  (8) a second fastening portion formed on said second end of said lamp cover;

(c) a shaft pivotally connecting said first and second hinge shaft-receiving portions of said first hinge portion with said third and fourth hinge shaft-receiving portions of said second hinged portion; and (d) a fastening member to releasably fix said first and second fastening portions together.

2. A lamp cover assembly according to claim 1, wherein each of said hinge-receiving portions of said first hinge portion comprises a closely fitting hole for receiving said shaft, and each of said hinge shaft-receiving portions of said second hinge portion comprises an elongated and elliptical hole for receiving shaft so that said lamp cover is pivotally movable in a direction parallel to said surface of said appliance thereby allowing said lamp cover to be easily opened or closed.

3. A lamp cover assembly according to claim 2, wherein said fastener member is a screw.

* * * * *